United States Patent [19]

Garner

[11] Patent Number: 4,566,264

[45] Date of Patent: Jan. 28, 1986

[54] MANUFACTURE OF TELECOMMUNICATIONS CABLE CORE UNITS

[75] Inventor: John N. Garner, Kingston, Canada

[73] Assignee: Northern Telecom Limited, Montreal, Canada

[21] Appl. No.: 637,587

[22] Filed: Aug. 3, 1984

[51] Int. Cl.[4] ..... B65H 57/06; D01H 1/04; D01H 7/48

[52] U.S. Cl. ..... 57/314; 57/68; 57/350; 57/352

[58] Field of Search ..... 57/3, 6, 13, 14, 15, 57/314, 350, 352, 68; 242/157 R

[56] References Cited

U.S. PATENT DOCUMENTS

| | | | |
|---|---|---|---|
| 2,412,196 | 12/1946 | Ashbaugh et al. | 57/314 X |
| 2,530,726 | 11/1950 | Rasmussen | 57/314 X |
| 2,572,052 | 10/1951 | Pheazey | 57/314 X |
| 2,882,676 | 4/1959 | Bryan et al. | 57/14 X |
| 3,369,355 | 2/1968 | Burr | 57/6 X |
| 4,248,035 | 2/1981 | Skillen et al. | 57/6 |
| 4,459,799 | 7/1984 | Beucher | 57/314 X |

*Primary Examiner*—Stuart S. Levy
*Assistant Examiner*—Joseph J. Hail, III
*Attorney, Agent, or Firm*—R. J. Austin

[57] ABSTRACT

Forming a telecommunications cable core unit in which conductor pairs change their relative positions along the core unit. The conductor pairs, as they are fed towards a core-unit forming device, are passed through individual guides which are movable independently of each other laterally of the feedpath of the conductor pairs and within certain confines. A fluid force is used to cause this guide movement. The fluid force may be the force created by an air flow, in which case the guides are buoyant.

12 Claims, 13 Drawing Figures

MANUFACTURE OF TELECOMMUNICATIONS CABLE CORE UNITS

This invention relates to the manufacture of telecommunications cable core units.

A telecommunications cable is constructed with a core comprising one or more core units, each having a multiplicity of units of twisted conductors, each conductor unit conventionally being a twisted pair of conductors. A core may be formed as a single core unit of twisted pairs, e.g. 50 or 100 pairs, or larger cores, i.e. up to 3,600 twisted pairs, comprises a plurality of core units. The twisted pairs are stranded together to form a core unit with the conductors of each pair twisted together with a predetermined lead to the twist, i.e. the distance taken along the pair for each conductor to complete a single revolution along its path. This distance will be referred to in this specification as the "twist lay" of a pair. There are different twist lays provided for the twisted pairs in a core unit with a pair having a particular twist lay being adjacent to other pairs of different twist lays. Care is taken, so far as is practicable, to ensure that pairs of equal or similar twist lays are separated from each other. The reason for this arrangement is to attempt to maximize the communications performance of the cable, e.g. to lessen pair-to-pair capacitance unbalance, to reduce crosstalk between pairs and to lower the coefficient of deviation of mutual capacitance of pairs in the cable.

In a conventional core unit, the twisted conductor pairs retain their positions relative to other pairs, within certain limits. However, it is recognized that the pair-to-pair capacitance unbalance and crosstalk between pairs is dependent to a large degree upon the distance of the two pairs from one another. To reduce pair-to-pair capacitance unbalance and to reduce the crosstalk, suggestions have been made to move the conductor pairs relative to one another as they progress towards a stranding machine for stranding them into a core unit so that in the finished core unit, the conductor pairs change in relative positions and distances apart. In a suggested method for changing the relative positions of conductor pairs as they move towards the stranding machine, the conductor pairs enter a guide arrangement which comprises a system of horizontal guides movable horizontally and located in vertically tiered fashion. The pairs are distributed throughout the tiers and relative horizontal movement of the guides changes the relative positions of the pairs as they move downstream. This method was suggested by Sigurd Norblad of Telefonaktiebolaget LM Ericsson, in a paper entitled "Multi-Paired Cable of Non Layer Design for Low Capacitance Unbalance Telecommunication Networks" read before the International Wire and Cable Symposium in 1971. The method involves the use of sideways physical forces upon conductor pairs and this could render it unsuitable for use on conductors insulated with pulp which is sensitive to the degree of surface pressures which are inherent with such forces.

The present invention concerns a method and apparatus for making core units involving changing the relative positions of conductor units before they are brought together to form a core unit and in which the high degree of surface pressures of previous apparatus is avoided.

Accordingly, the present invention provides an apparatus for forming a core unit from telecommunications conductor units, each formed of twisted togther insulated conductors and in which the relative positions of the conductor units are changed along the core unit, the apparatus comprising in order, downstream along a feedpath for the units:

guide means to ensure that conductor units are not stranded together as they move downstream from the guide means;

position changing means for conductor units, including a plurality of independent guides for the units, the guides movable independently of and relative to each other in any direction within confines laterally of the feedpath and under the influence of a fluid force, and fluid force producing means to apply a fluid force across the feedpath to cause the independent movement of the guides; and a core unit forming and take-up means to draw the conductor units together to form the core unit.

In the apparatus according to the invention, the fluid force producing means may comprise a gas passage means which is disposed at a gas flow station along the feedpath. The gas passage means is for the purpose of directing a flow of gas upwardly towards and across the feedpath and a means is provided to produce the gas flow across the passage means. In this arrangement, each guide is buoyant so as to be buoyed up by the gas flow whereby the independent guide movement is provided. The gas passage means may be assisted in causing movement of the guides by an electromagnetic means which is energizable to create a magnetic field extending across the feedpath and to change a characteristic of the field. In this case, at least some of the guides include a magnetically permeable material to influence in conjunction with the magnetic field created by the electromagnetic means, the positions of the guides transversely of the feedpath.

The invention also includes a method of forming a core unit from telecommunications conductor units, each comprising twisted together insulated conductors and in which the relative positions of the conductor units are changed along the core unit, the method comprising:

passing conductor units separately and side-by-side along a feedpath and through a plurality of independent guides which are laterally movable independently of each other in any direction within certain confines and laterally of the feedpath under influence of a fluid force;

applying a fluid force across the feedpath to cause independent movement of the guides and thus cause relative sideways movement of the conductor units and constant change in their positions in a plane normal to the feedpath; and passing the conductor units in their constantly changing positions into a core unit forming and take-up means to draw the conductor units together into the core unit, the relative positions of the conductor units in the core unit at any position along the length thereof influenced by the relative positions of the conductor units as they are drawn into the forming and take-up means.

Embodiments of the invention will now be described by way of example, with reference to the accompanying drawings, in which.

Figure 1:
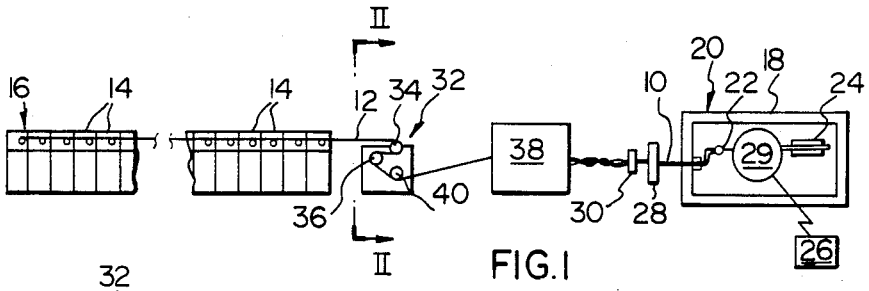
FIG. 1 is a side elevational view of a general in-line apparatus for twisting conductor units and stranding them together in a tandem operation.

As shown by FIG. 1, apparatus for forming a core unit 10 from conductor pairs 12 of twisted together conductors generally comprises twenty-five twisting machines 14 which are disposed in a single straight bank 16 of machines. Each twisting machine 14 is of conventional construction (not shown) and comprises, in conventional manner, a reel cradle for holding in rotatable fashion two reels of individually insulated conductors to enable the conductors to be drawn from the reels under the drawing influence of a stranding machine 18. Each machine 14 comprises either a single flyer in conventional manner, or it may comprise two flyers and associated pulleys to provide a balanced rotational structure such as is described in a copending patent application entitled "Twisting Machine", filed Dec. 27, 1983 in the names of J. Bouffard, A. Dumoulin and E. D. Lederhose under U.S. application Ser. No. 565,635 (Canadian equivalent application No. 444,294 filed Dec. 23, 1983). The conductors as they are drawn through the flyer of each machine are drawn together towards the top of the machine, to become twisted together, and are then fed outwardly as a twisted conductor pair 12 from and along the bank 16 of machines as shown in FIG. 1.

The stranding machine 18 forms part of a core unit forming and take-up means 20 which also comprises a flying strander 22 and includes a helper capstan 24. The helper capstan is to assist in the drawing of the core unit 10 into the machine 18, the main force for which is taken by a motor 26 which drives a core unit take-up reel 29. Upstream of the flying strander 22 is a drawing means in the form of a closing die 28 for drawing the conductor pairs together, and a binding head 30. As the structure is conventional, no further description is required.

Figure 2:
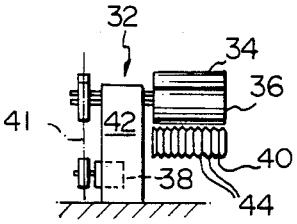
FIG. 2 is a cross-sectional view along lines II—II in FIG. 1 and on a larger scale.

Because the twisting and core unit operation is performed in tandem, then a tension reducing means is necessary in the apparatus shown in FIG. 1. The tension reducing means is of the construction described in a U.S. patent application Ser. No. 565,634, filed Dec. 27, 1983, entitled "Forming Cable Core Units" and in the names of J. Bouffard, A. Dumoulin and M. Seguin. As described therein, the tension reducing means 32 comprises two drivably rotatable cylinders 34 and 36 around each of which the conductor pairs pass after leaving the bank 16 of twisting machines and moving towards the stranding machine. The two cylinders are of substantially equal diameter and have a common drive in the form of a drive motor 38, which is connected to the cylinder 34 by drive belt 41, as shown in FIG. 2. A drive belt (not shown) also drivably connects the two cylinders together. The drive motor 38 is electrically influenced by the line speed to provide a peripheral speed to each of the cylinders 34 and 36 which is slightly in excess of the drawing speed of the conductor pairs into the stranding machine. The degree of excess in speed is subject to choice, dependent upon design, but in this particular machine lies between one and five percent and is preferably in the region of three percent. It is of importance to realize that the two cylinders 34 and 36 are not a capstan drive and do not operate in the accepted sense for drawing twisted pairs of conductors through apparatus in cable manufacture. As described in application serial number 565,634, the cylinders 34 and 36 do not engage each of the conductor pairs along a sufficiently long arc of contact to provide enough frictional grip to draw the pairs from the twisting machines 14 without the assistance of tension upon the pairs downstream of the cylinders and as provided by the rotation of the reel 18. Hence, if the stranding machine were omitted, the cylinders 34 and 36 would be incapable of drawing conductor pairs 12 from the twisting machines. Additional frictional grip between the cylinders and the conductor pairs is created by tension downstream of the cylinders pulling the pairs down onto the cylinder surfaces. While this tension is maintained, the cylinders will draw the conductor pairs from the twisting machines with some slippage because of the excess peripheral speed of the cylinders.

If the grip of the cylinders tend to increase the speed of any pair as it passes around them, towards its draw speed into the stranding machine, then the downstream tension from the cylinders decreases and the frictional grip of the pair around the cylinders is lessened. Thus, the cylinders slip to a greater extent upon the conductor pair and there is a decrease in the tendency for further increase in speed of the pair, as caused by the drive of the cylinders. In any event, if the downstream tension from the cylinders drops towards zero in any conductor pair, the cylinders could not drive that conductor pair around the cylinders at a speed equal to the draw speed of the twisting machine because increase in slippage would prevent this.

Between the tension reducing means 32 and the closing die 28 is disposed a position changing means 38, which is the main feature of the present invention. This position changing means may take various forms, as shown by the following embodiments of the apparatus now to be described. In all of these embodiments and according to the invention, the apparatus for forming a core unit includes a guide means to ensure that conductor units are not stranded together as they approach the position changing means 38. The guide means may be any suitable device for holding conductor pairs separate from one another as they are fed side-by-side through the apparatus. Conveniently, however, in the apparatus described in this specification, the guide means comprises a freely rotatable guide roller 40 which is carried upon a stand 42 of the machine which also carries the cylinders 34 and 36. As shown by FIG. 2, the guide roller 40 is formed with annular peripheral grooves 44 which space the conductor pairs apart and arrange them in a planar array for them to continue through the position changing means 38.

Figure 3:
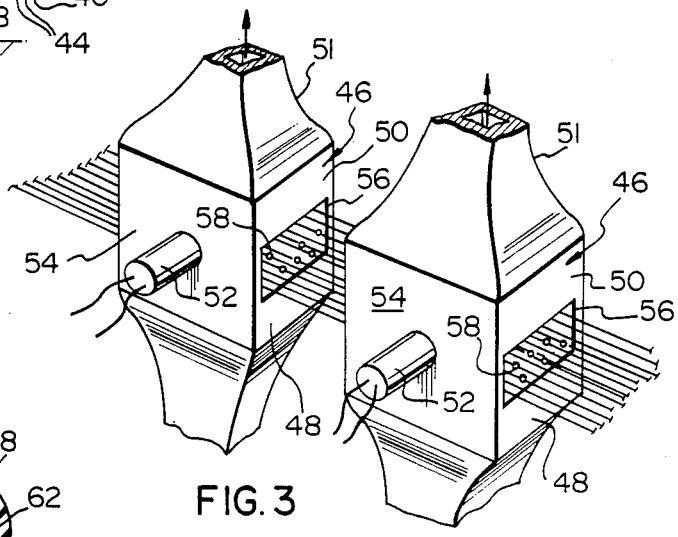
FIG. 3 is an isometric view on a larger scale of a position changing means of an apparatus according to a first embodiment and as shown generally in FIG. 1.
Figure 4:
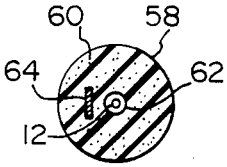
FIG. 4 is a cross-sectional view through part of the position changing means of the first embodiment.
Figure 5:
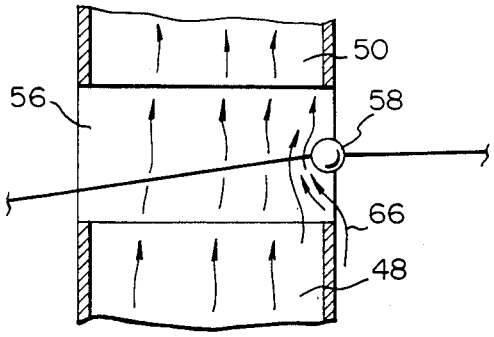
FIG. 5 is a cross-sectional view through part of the position changing means of the first embodiment.

Apparatus according to a first embodiment for forming a core unit comprises a position changing means of the construction shown in FIGS. 3, 4 and 5. In the first embodiment, the position changing means comprises a gas passage means disposed at a gas flow station along the feedpath for the conductor pairs. As shown by FIG. 3, this gas passage means comprises a plurality of housings 46 positioned in series along the feedpath. FIG. 3 merely shows two of these housings, but in this embodiment four are actually provided to assist in providing independent movement of conductor pairs, as will be described. The four housings 46 are identical in construction. Each housing extends across the feedpath for the conductor pairs and defines a gas duct 48 below the feedpath and a gas duct 50 above the feedpath, both gas ducts being of rectangular configuration, as shown by FIG. 3, and in vertical alignment so that gas issuing upwardly from the lower duct passes across the feedpath into the duct 50. Gas pressurizing means (not shown) is provided for forcing the flow of gas, i.e. air, upwardly through the duct 48 and an exhaust 51 is associated with the duct 50 for withdrawing the air.

The gas passage means and associated equipment for causing the airflow form part of a fluid force producing means to apply the fluid force across the feedpath. The fluid force producing means also includes an electromagnetic means which is energizable to create a magnetic field extending across the feedpath at the gas flow station and also to change a characteristic of the field for reasons to be discussed. With respect of each of the housings 46, the electromagnetic means comprises an electrical coil 52 disposed at each side of the housing and in a position between the ducts 48 and 50. In practice as shown, each of the coils 52 is attached to a side member 54 of the housing, the side member extending between the ducts 48 and 50 so as to define with the ducts a rectangular passageway 56 which defines the feedpath for the conductor pairs. Each of the coils 52 is connected to a source of electrical energy for intermittent and independent operation for the purpose of changing not only the flux intensity of the magnetic field produced either by each coil singly or the two coils together, but also to change directions of the flux lines dependent upon the strength of the current passing through the coils at any particular time.

The position changing means also includes a plurality of independent guides, one for each conductor pair. Six guides are associated with each of the first three housings 46 (two only being shown) and the remaining seven guides with the downstream housing (not shown).

As shown by FIGS. 3, 4 and 5, each of the guides 58 is substantially spherical. In the detail shown in FIG. 4, each guide 58 is formed with a closed cell foam plastics body 60 having a central diametrical passage 62 for carrying a conductor pair. Each guide 58 also includes a magnetically permeable member which is a conventional permanent bar magnet 64 having its poles at the ends.

In use of the apparatus, the pairs 12 of conductors are fed from their respective twisting machines 14 and through the tension reducing means 32 towards the in-series housings 46. In the tension reducing means 32, each conductor pair passes around the two cylinders 34 and 36, as shown, and then around the guide roller 40 with a conductor pair in each of the grooves 44 so that the pairs are maintained separately from one another. As the conductor pairs pass around the cylinders 34 and 36, the pull of the stranding machine 20 increases the frictional contact of the pairs against the surface of the cylinders. Although the cylinders are rotating at a peripheral speed which is greater than the throughput speed of the conductor pairs into the stranding machine, their degree of grip upon the pairs is insufficient to draw the pairs from the twisting machine at the peripheral speeds of the cylinders. This is as explained above and in greater detail in the aforementioned U.S. patent application Ser. No. 565,634. Rather, the degree of drive by the cylinders is dependent upon the frictional grip upon them by the conductor pairs which increases and decreases in proportion to the downstream tension created by the draw of the stranding machine. Hence, the pull by the cylinders upon each pair increases its speed until it approaches that of the draw speed of that pair into the stranding machine sufficiently to reduce the frictional grip of the conductor pair upon the cylinders to remove the driving force. Any slight increase in the downstream tension from the cylinders will improve their driving engagement with the pair, thereby reducing the tension again. It follows that the tension which has built up during twisting of each conductor pair from its machine 14 and during its movement into the tension reducing means (e.g. up to 3 lbs.) is reduced on the downstream side to an acceptable level (e.g. about 0.5 lbs.) for drawing into the stranding machine. This reduction in tension assists, but is not essential to, the operation of the position changing means for independently moving the guides 58 which will now be described.

As shown by FIG. 3, the twenty-five conductor pairs 12 pass in the planar array (left hand side of FIG. 3) towards the first housing 46. The conductors pass through the passageways 56 of all the housings and each conductor pair passes also through one of the guide holes 62 of a guide 58 so that each guide is associated with a particular conductor pair. The guides are associated with particular housings as discussed above. Each guide is located upon its conductor pair and disposed within the particular passageway 56 formed by its associated housing. The passage of the airflow through each passageway 56 lifts the guides 58 in that space because of the buoyancy of the guides themselves, thereby causing them to move vertically and slightly horizontally relative to the other guides in that passageway and also relative to the conductors passing through that passageway but devoid of guides at that position. Hence, the vertical movement of the guides 58 at any particular housing effects some independent movement of the guides and thus of the conductor pairs at that position. The movement of the conductor pairs along the feedpath imposes a drag upon the guides which tends to move them in the downstream direction. However, the upward passage of the airstream prevents each guide from completely leaving its particular passageway 56 by virtue of the Bernoulli effect. This action is shown by FIG. 5. The two ducts 48 and 50 are formed with downstream planar ends which have the effect of forming a curtain of air through the passageway 56. This air curtain tends to drag air upwardly along the downstream edge of the duct 48 and upwardly into the duct 50. This is shown by the arrow 66 in FIG. 5. With no conductor pair passing through each guide 58, then the guide would tend to lie towards the centre, i.e. between upstream and downstream ends, of the associated passageway 56. However, the drag of the conductor pair upon the guide urges the guide towards the downstream end of its passageway. As the guide approaches the downstream end and commences to move out of the passageway 56, as shown in FIG. 5, then there is a higher pressure on the downstream side of the guide than at the upstream side because of the airflow upwardly through the passageway 56 which is assisted by the airflow at 66, as previously indicated. Thus, a Bernoulli effect is provided which tends to draw the guide back into the passageway 56. However, the drag effect of the conductor pair will not allow this to happen and each guide 58 assumes a position at the downstream end of the passageway 56, as shown by FIG. 5, in which the drag load upon the guide caused by the conductor pair balances the inward force created by the Bernoulli effect attempting to draw the guide upstream. Hence, each of the guides 58 assumes a position of balance, as shown by FIG. 5, in which it is buoyed upwardly by the airflow.

During operation of the airflow, the coils 52 at each side of each passageway 56 are energized intermittently and independently of one another to create the magnetic field across the passageway 56. This field is constantly changing in flux strength and in direction of the lines of force and thus changes its influence upon the magnets 64 in each of the guides 58. As the field strength at different positions across the space is different, then the guides 58 are caused to move laterally in different ways at different times. In consequence of the combined effects of the airflow and the changing magnetic field, the guides are moved independently of each other, both laterally and vertically, thereby changing the relative positions of the conductor pairs passing through them and also relative to other conductors passing through that particular passageway 56 and without guides in that passageway.

It follows that at each of the housings 46, some of the conductor pairs are changed in their positions relative to the other conductor pairs. Movement of the guides, both laterally and vertically in each of the passageways 56, is constant and thus the relative positioning of the conductor pairs is constantly changing.

After passing through the position changing means 38, the conductor pairs then proceed through the closing die 28 and into the stranding machine. The relative positions of the pairs at any instant, as they pass through the closing die, are influenced by the relative positions of the pairs as they move from the position changing means 38. This affects the relative positions and change in positions of the pairs in the core unit 10. Hence, in the completed stranded core unit, the pairs change their relative positions to each other in a completely randomized fashion.

As may be seen, little pressure is required to move the conductor pairs during their passage through the guides 58. The buoyancy of the guides ensures the movement of the pairs easily and effectively without imposing a significant positive sideways force which would be experienced with the movement of a mechanical device. This is of importance in a case where a pulp insulated conductor is being formed into a core unit as this could be damaged by the use of conventional mechanical moving devices engaging the surface of the pulp, i.e. with a crushing effect. Lack of crushing ensures that there is no variation in electrical properties in the finished cable, e.g. in mutual capacitance between conductors.

The reduction in tension in the conductor pairs as described with the use of the tension reducing means 32 does, of course, reduce any resistance to sideways movement of the conductor pairs and assists in minimizing any damage which may be caused to the insulation. However, with this invention, exemplified by the first and further embodiments to be described, the reduction in tension in the conductor pairs is unnecessary.

The apparatus according to the invention does not, of course, need to be for use in the tandemization of twisting conductor pairs and of forming a core unit as described with reference to FIG. 1. For instance, apparatus according to the invention and including a postion changing means may be of more conventional construction in that the core unit 10 formed by the core unit forming and take-up means 20 may have the structure shown in FIG. 6. In that Figure, the position changing means 38 and part of the apparatus downstream therefrom are as described above. The conductor pairs 12 have been previously twisted in conventional manner and are carried upon reels 70, from which they are fed, towards the position changing means 38. Little tension is required to pull the conductor pairs from each of the reels and to pass them directly around guide pulleys and also around a guide means to ensure that the conductor pairs are not stranded together before entering the position changing means 38. In this particular case, the guide roller 40, as described in a first embodiment, is again employed as the guide means.

In other embodiments, now to be described, the apparatus is basically as described above with regard to FIG. 1 or FIG. 6, but the position changing means, indicated generally as item 38, is changed in each case from that described in the first embodiment.

In a second embodiment, the position changing means comprises electromagnetic means which are not assisted by gas flow means. In this embodiment, the apparatus comprises a cylindrical housing in two coaxial housing portions 80 and 82 and which extend along and surround the feedpath for the conductor pairs. These housings are cylindrical magnets having radially spaced poles.

Figure 7:
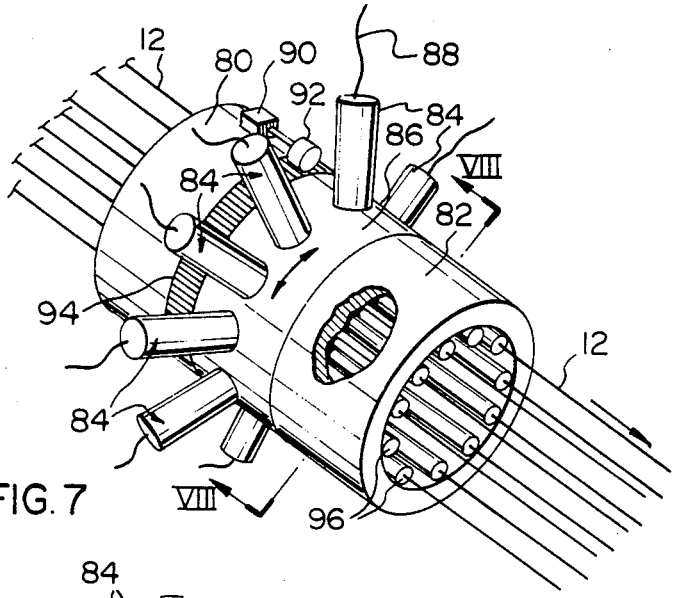
FIG. 7 is an isometric view on a larger scale of a position changing means of apparatus according to a second embodiment.

The electromagnetic means further comprises a plurality of electromagnets 84 which are radially disposed relative to the cylindrical housing in spaced apart positions around the feedpath, as shown in FIG. 7. Each electromagnet is energizable independently of the other electromagnets to change a characteristic of a magnetic field which is to be produced, as will be described, and the electromagnets are mounted upon an annular carrier 86 which is disposed between the housing portions 80 and 82. The carrier 86 is rotatable for at least part of a revolution around the feedpath. In practice, as in this embodiment, because of the convenience of connecting each of the electromagnets to a source of electricity by wires 88, then the carrier 86 is rotatable for only part of a revolution to enable the wire connections to be made. In fact, the carrier is reciprocally rotatable around an angle possibly between 60 and 90 degrees around the feedpath. The carrier may be rotated, for instance, by a stepping motor 90 and a drive shaft and gear 92 which is in mesh with an annular gear 94, located at one axial end of the carrier 86.

Figure 8:
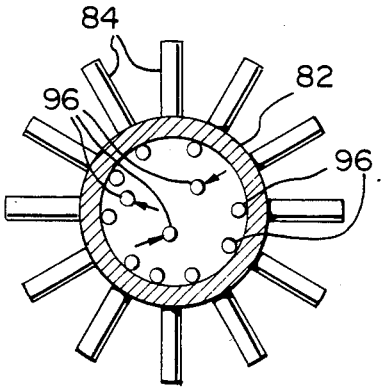
FIG. 8 is a cross-sectional view through the position changing means of the second embodiment taken along line VIII—VIII in FIG. 7.

Located within the housing and the carrier 86 are a plurality of guides, one guide for each of the conductor pairs. As shown in FIGS. 7 and 8, some of the guides for the twenty-five pairs are omitted for clarity. Each of these guides is formed from a magnetically permeable material and, in fact, comprises a tubular permanent magnet 96 of substantial length so as to extend for substantially the whole axial length of the housing portions or cylindrical magnets 80 and 82. The permanent magnets 96 have their poles displaced radially of one another, each magnet having its outer pole with the same polarity as the pole at the inner surface of the cylindrical magnet portions 80 and 82.

Figure 6:
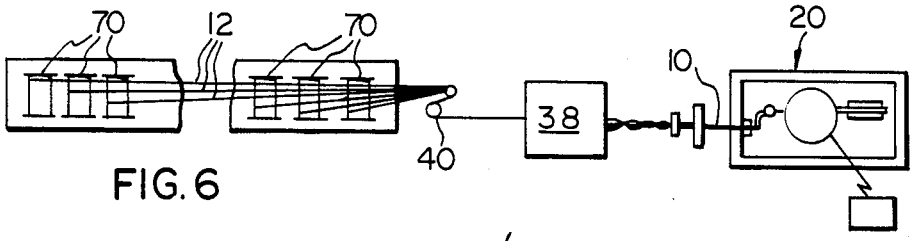
FIG. 6 is a view similar to FIG. 1 of an alternative general apparatus.

In use of the apparatus of the second embodiment, the conductor pairs are fed through the apparatus towards the position changing means. After the conductor pairs have passed around the guide roller 40, as shown in FIGS. 1 or 6, the pairs then pass axially through the cylindrical magnets 80 and 82 while also passing each through one of the tubular magnets 96. The conductor pairs then proceed towards the closing die and the stranding machine. As may be expected, the tubular magnets 96 are attracted to the inner surface of the cylindrical magnets 80 and 82, in which position they will remain unless acted upon by some external force. To cause the tubular magnets to move independently of one another and within the cylindrical magnet, the electromagnets 84 are energized intermittently and independently of each other while being rotated reciprocally around the feedpath in the manner described. Whenever an electromagnet, or electromagnets, is energized, a magnetic field which has been created between the cylindrical magnet and the tubular magnets has its characteristics changed, i.e. the flux strength or direction of the flux lines is altered. More importantly, the electromagnets are polar orientated in such a way that, upon being energized, each electromagnet repels any tubular magnet which is adjacent to it through the thickness of the cylindrical magnet. Any tubular magnet so displaced is immediately drawn by the cylindrical magnet to a new position upon the wall of the cylindrical magnet so that the positions of the tubular magnets, and thus of the conductor pairs, constantly change as the pairs are fed through the apparatus. FIG. 8 shows positions of tubular magnets in the cylindrical magnet during operation of the apparatus, and also illustrates the movement of certain tubular magnets 96 across the feedpath to assume new positions when repelled from the cylindrical magnet by energization of the appropriate electromagnets.

Thus, the conductor pairs in the use of the second embodiment are constantly changed in position as they are fed towards the stranding machine so that the effect achieved in the first embodiment again results. It follows from this that the relative positions of the conductor units in the finished core unit at any position along the length of the core unit are influenced by the relative positions of the conductor units as they are drawn into the forming and take-up means. The relative positions of the conductor pairs in the finished core unit therefore change in a random fashion.

In a modification of the second embodiment (FIG. 9), the apparatus is visually exactly as described above. However, in the modification, the polarity around the outer surface of the tubular magnets and around the inner surface of the cylindrical magnets 80 and 82 is the same, so that the cylindrical magnets repels the tubular magnets from it. In this case, the electromagnets 84 when energized serve to attract the tubular magnets towards them. Thus, in use, the cylindrical magnet tends to move the tubular magnets towards the axis of the feedpath and the tubular magnets move around each other because of their mutual repelling forces. Energization of any electromagnet 84 attracts the closest tubular magnets toward the inner surface of the cylindrical magnet, thereby causing relative movement of the tubular magnets. When any electromagnet 84 is de-energized, then the tubular magnets which have been attracted towards it immediately move back towards the axis of the feedpath and assume new positions within the tubular magnet group.

Figure 9:
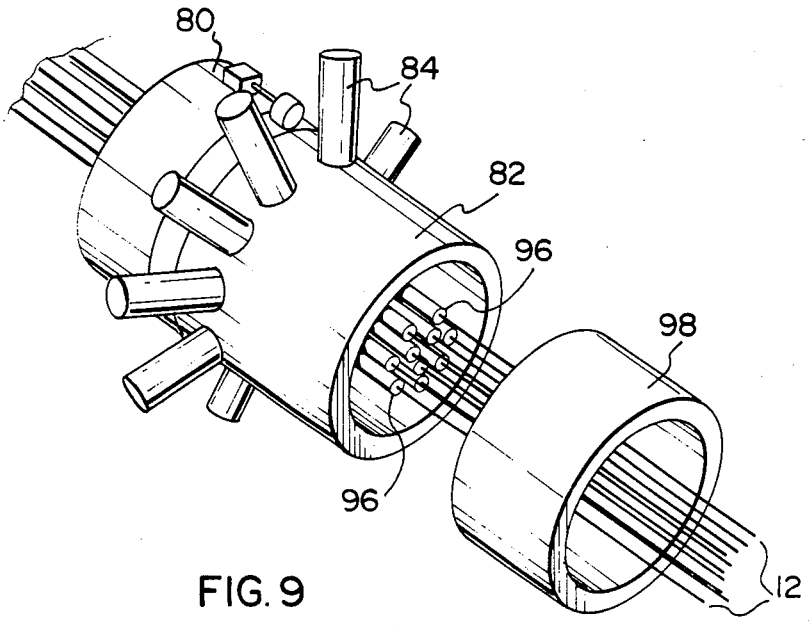
FIG. 9 is an isometric view of a position changing means according to a modification of the second embodiment.

The modification of the second embodiment differs from the second embodiment in that it is provided with a limiting means for the tubular magnets to prevent the tubular magnets moving downstream, both under the pull of the conductor pairs and under the repelling force of the cylindrical magnets 80 and 82. This limiting means is shown in FIG. 9. The limiting means is in the form of a housing 98 which surrounds the feedpath, as shown. The housing may be of any suitable shape, but in this case is cylindrical. The housing is substantially coaxial with the cylindrical magnet and is placed sufficiently close to the ends of the tubular magnets to provide positive limiting action to their downstream movement. The housing 98 is itself a magnet having axially displaced poles with its upstream end having the same polarity as the outer surfaces of each of the tubular magnets. Thus, if there is any tendency for the tubular magnets to move downstream, then this is prevented by the repelling magnetic force created between the like poles of the tubular magnets and the housing 98.

Figure 10:
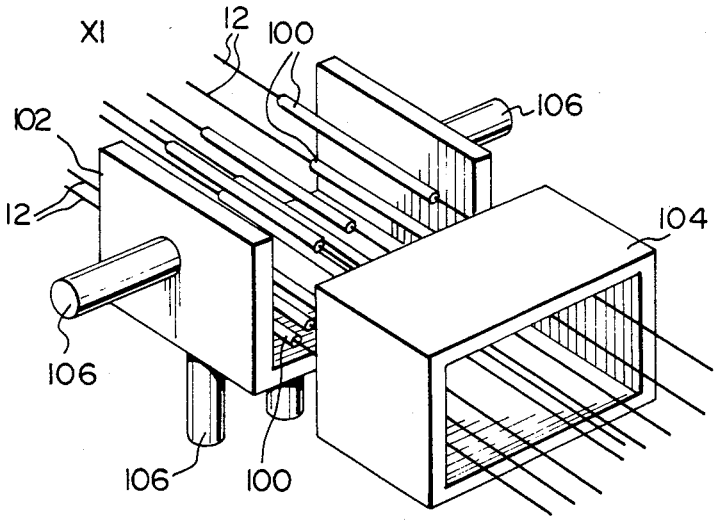
FIG. 10 is an isometric view of a position changing means according to a third embodiment.
Figure 11:
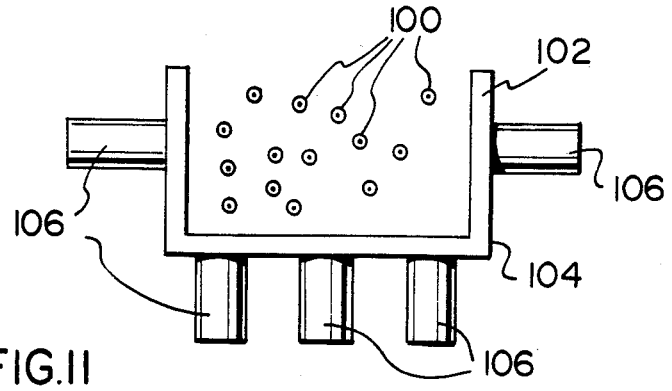
FIG. 11 is an end view of the position changing means in the direction of arrow XI in FIG. 10.

A third embodiment is illustrated in FIGS. 10 and 11. In this embodiment, the repelling action of a housing is used to levitate the guides for the conductor pairs and is similar in its action in some ways to the modification of the second embodiment.

In the third embodiment, the position changing means comprises a plurality of tubular magnets 100 to act as guides, one for each of the conductor pairs. The polarity of the guides is as described in the second embodiment. The feedpath for the conductor pairs is bordered beneath it and at its two sides by a three-sided housing 102, which is itself a magnet. The polarity of the magnet 102 is such that its poles are displaced through its thickness with the polarity at its inner surface the same as the polarity at the outer surface of the tubular guides 100. Thus, the repelling force of the housing 102 holds the guides 100 levitated away from its base and away from the sides. To prevent the guides 100 from moving downstream, a miting means is provided which is a surrounding housing 104 spaced slightly away from the housing 102 in the downstream direction. The housing 104 is itself a magnet having axially displaced poles and the upstream polarity repels that at the outside surface of the tubular magnets 100. Thus, as discussed with regard to the modification of the second embodiment, the tubular magnets are retained in position along the feedpath by the repelling force of the housing 104 against any tendency for the tubular magnets to be forced away from the housing 102 by the magnetic field at that position, and also by the drag imposed by the conductor pairs. The housing 102 also includes an electromagnetic means comprising a plurality of electromagnets 106 positioned at and carried by the sides and base of the housing, as shown in FIGS. 10 and 11.

In use of the apparatus of the third embodiment, the conductor pairs are fed in unstranded fashion, as described above, through the tubular magnets 100, one through each magnet. The pairs then proceed towards the closing die and the stranding machine to form the core unit. The tubular magnets are held in levitated position within the housing 102 by the mutual repelling force of housing and magnet and the conductor pairs themselves prevent the tubular magnets from being repelled upwardly and completely from within the housing. To effect independent and relative movement of the tubular magnets, the electromagnets 106 are energized intermittently so as to change the flux pattern and strength of the magnetic field within the housing in a randomized fashion. This change in the field affects each of the tubular magnets differently because of their different positions, and hence relative movement, either vertically or horizontally, of the magnets takes place. Thus, the positions of the conductor pairs constantly change as they move through the housing 102 and this constantly changing position is reflected in the constantly changed positions along the length of the finished core unit.

Figure 12:
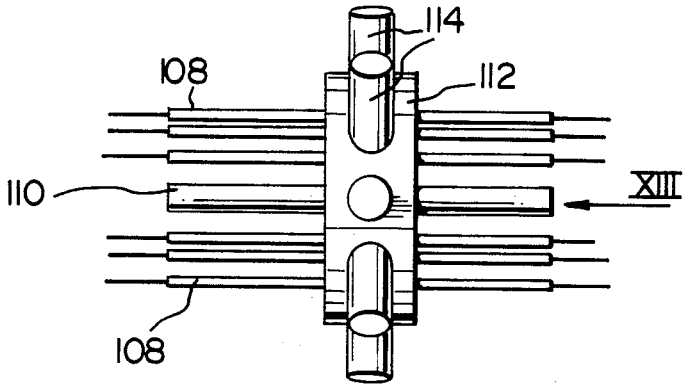
FIG. 12 is a plan view of a position changing means of apparatus according to a fourth embodiment.
Figure 13:
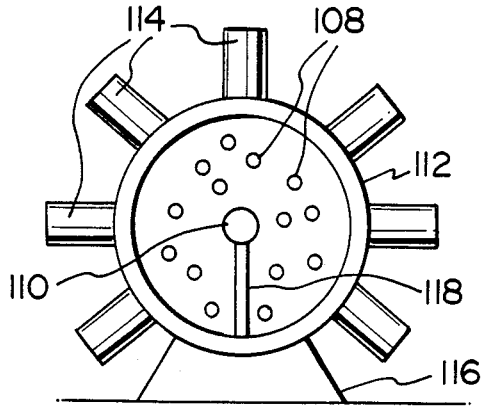
FIG. 13 is an end view in the d1rection of arrow XIII upon the position changing means of FIG. 12.

In a fourth eabodiment as illustrated in FIGS. 12 and 13, in a position changing means, guides 108 for the conductor pairs are again tubular magnets of the same structure as described in the second embodiment. A fluid force producing means in this construction comprises an inner bar magnet 110 which, as can be seen, is disposed centrally of the feedpath which is defined outwardly by a cylindrical housing 112. As shown by FIG. 12, the bar magnet 110 extends substantially the whole length of the tubular magnets 108, whereas the cylindrical housing is axially shorter and is of sufficient axial length for the purpose of supporting electromagnetic means in the form of a plurality of electromagnets 114 in spaced apart positions around the feedpath. The cylindrical housing is carried by a base plate 116 and the bar magnet 110 is itself carried upon a support by a non-permeable plate 118. The bar magnet has radially displaced poles, with the outer pole being of the same polarity as the outer pole of each of the tubular magnets 108.

In use of the apparatus of the fourth eabodiment, the tubular magnets and their conductor pairs are supported in normal supported positions in their passage through cylinder 112 by guide rollers (not shown) upstream and downstream of the cylinder. The magnets are repelled from the bar magnet so that they move outwardly within the space defined by the cylindrical housing 112 and from their normal supported positions. Upon any of the electromagnets 114 being energized independently and intermittently, this energization changes the pattern of the magnetic field within the housing, thereby displacing a tubular magnet or magnets relative to others and this displacement is enhanced by the fact that the tubular magnet needs to avoid the bar magnet 110. Thus, a randomized movement of the tubular magnets result.

In a modification of the fourth embodiment (not shown), the electromagnets 114 are rotatable around the feedpath. This may be effected by rotatably mounting the cylindrical housing 112, possibly in the manner described with regard to the carrier 86 described in the second embodiment.

I claim:

1. Apparatus for forming a core unit from telecommunications conductor units, each formed of twisted together insulated conductors and in which the relative positions of the conductor units are changed along the core unit, the apparatus comprising in order, downstream along a feedpath for the units:

guide means to ensure that conductor units are not stranded together;

position changing means for conductor units including a plurality of independent guides for the units, the guides movable independently of each other in any direction and within confines of a certain space extending laterally of the feedpath under the influence of a fluid force, and fluid force producing means to apply a fluid force across the feedpath to cause the independent movement of the guides; and a core unit forming and take-up means to draw the conductor units together to form the core unit.

2. Apparatus according to claim 1, wherein the fluid force producing means comprises gas passage means at a gas flow station along the feedpath, the gas passage means to direct a continuous flow of gas upwardly towards and across the feedpath and to withdraw it therefrom and means to produce gas flow through the gas passage means, and each guide is buoyant so as to be supported by the gas as it crosses the feedpath.

3. Apparatus according to claim 2, wherein each guide is substantially spherical and is formed with a guide passage therethrough for a conductor unit.

4. Apparatus according to claim 2, further comprising an electromagnetic means energizable to create a magnetic field extending across the feedpath at the gas flow station and to change a characteristic of the field, and at least some of the guides include magnetically permeable members to influence, in conjunction with the magnetic field to be created by the electromagnetic means, the positions of the guides with the permeable members, transversely of the feedpath and within the gas flow station.

5. Apparatus according to claim 4, wherein each guide is substantially spherical and is formed with a guide passage therethrough for a conductor unit.

6. Apparatus according to claim 5, wherein each guide comprises a foam plastics body with at least some of the guides carrying the magnetically permeable members.

7. Apparatus according to claim 4, wherein each magnetically permeable member comprises a permanent magnet.

8. Apparatus according to claim 2, wherein the gas passage means comprises a gas duct below the feedpath and a gas duct above the feedpath with the two gas ducts in line and spaced by the feedpath and having downstream planar ends extending across the feedpath and substantially normal to it, and wherein side members extend upwardly at each side of the feedpath to retain the guides in position between the gas ducts.

9. Apparatus according to claim 8, wherein electromagnetic means is carried by at least one side member, the electromagnetic means energizable to create a magnetic field extending across the feedpath at the gas flow station and to change a characteristic of the field, and at least some of the guides include magnetically permeable members to influence, in conjunction with the magnetic field to be created by the electromagnetic means, the positions of the guides with the permeable members, transversely of the feedpath and within the gas flow station.

10. A method of forming a core unit from telecommunications conductor units each comprising twisted together insulated conductors and in which the relative positions of the conductor units are changed along the core unit, the method comprising:

passing conductor units separately and side-by-side along a feedpath and through a plurality of guides which are laterally movable independently of each other in any direction within certain confines and laterally of the feedpath under influence of a fluid force;

applying a fluid force across the feedpath to cause constant independent movement of the guides and thus cause relative sideways movement of the conductor units and constant change in their positions in a plane normal to the feedpath; and passing the conductor units in their constantly changing positions into a core unit forming and take-up means to draw the conductor units together into the core unit, the relative positions of the conductor units in the core unit at any position along the length thereof influenced by the relative positions of the conductor units as they are drawn into the forming and take-up means.

11. A method according to claim 10, wherein the guides are buoyant and the method comprises applying a fluid force in the form of a flow of gas upwardly towards and across the feedpath and withdrawing it therefrom so as to buoyantly move the guides independently of each other.

12. A method according to claim 11, wherein some at least of the guides include magnetically permeable material and the method comprises influencing, in conjunction with the gas flow, the relative position of guides having the magnetically permeable material by subjecting them to the influence of a magnetic field across the fieldpath and changing a characteristic of the field.

* * * * *